US006542135B1

(12) United States Patent
Kasahara et al.

(10) Patent No.: US 6,542,135 B1
(45) Date of Patent: Apr. 1, 2003

(54) PLASMA PANEL DISPLAY DEVICE

(75) Inventors: Mitsuhiro Kasahara, Hirakata (JP); Yuichi Ishikawa, Ibaraki (JP); Tomoko Morita, Hirakata (JP); Makoto Kawachi, Ibaraki (JP); Tadayuki Masumori, Osaka (JP); Takao Wakitani, Takatsuki (JP); Toshio Wakahara, Osaka (JP); Akira Yawata, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/600,151

(22) PCT Filed: Dec. 6, 1999

(86) PCT No.: PCT/JP99/06823

§ 371 (c)(1),
(2), (4) Date: Jul. 18, 2000

(87) PCT Pub. No.: WO00/36581

PCT Pub. Date: Jun. 22, 2000

(30) Foreign Application Priority Data

Dec. 14, 1998 (JP) ..... 10-354448

(51) Int. Cl.[7] ..... G09G 3/28

(52) U.S. Cl. ..... 345/63; 345/60; 345/61; 345/690; 345/691; 345/692; 315/160; 315/169.1; 315/169.2; 315/169.3

(58) Field of Search ..... 345/60, 63, 690, 345/691, 692, 61; 315/169.1, 169.3, 160, 169.2

(56) References Cited

U.S. PATENT DOCUMENTS 3,993,990 A 11/1976 Miller et al.
5,436,634 A * 7/1995 Kanazawa ..... 345/67
6,333,766 B1 * 12/2001 Kougami et al. ..... 348/687
6,369,832 B1 * 4/2002 McKnight ..... 345/691
6,407,506 B1 * 6/2002 Naka et al. ..... 315/169.1

FOREIGN PATENT DOCUMENTS

| | | |
|---|---|---|
| GB | 2322220 | 8/1998 |
| JP | 8-320668 | 12/1996 |
| JP | 9-179520 | 7/1997 |
| WO | 99/30308 | 6/1999 |
| WO | 99/30309 | 6/1999 |

OTHER PUBLICATIONS

English Language Abstract of JP 9–179520.

English Language Abstract of JP 8–320668.

* cited by examiner

*Primary Examiner*—Richard Hjerpe
*Assistant Examiner*—Jennifer T. Nguyen
(74) *Attorney, Agent, or Firm*—Greenblum & Bernstein, P.L.C.

(57) ABSTRACT

The display device of the present invention is provided with a means (8) for setting the writing pulse width of the attentional light-emitting sub-field wider than the normal writing pulse width at all the gray scale levels in the case where at least two continuous non-light-emitting sub-fields possibly exist before the attentional light-emitting sub-field at a certain gray scale level among all the gray scale levels specified on the basis of the number Z of sub-fields and the weighting of the sub-fields. According to the display device of the present invention, the discharge for writing can be stably executed without reducing the number of sub-fields in one field.

8 Claims, 12 Drawing Sheets

Fig. 1A PRIOR ART

SF1

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 0 | 0 | 0 | 0 | 0 | 0 | 0 | 0 |
| 0 | 1 | 0 | 1 | 1 | 1 | 0 | 0 | 0 | 0 |

Fig. 1B PRIOR ART

SF2

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 0 | 0 | 0 | 0 | 0 | 0 | 0 |

Fig. 1C PRIOR ART

SF3

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig. 1D PRIOR ART

SF4

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig. 1E PRIOR ART

SF5

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig. 1F PRIOR ART

SF6

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig. 1G PRIOR ART

SF7

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig. 1H PRIOR ART

SF8

| | | | | | | | | | |
|---|---|---|---|---|---|---|---|---|---|
| 1 | 1 | 1 | 1 | 1 | 1 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |

ONEFOLD MODE
EIGHT SUB-FIELDS
256 TONE LEVELS

DIVIDED INTO TWO

ONEFOLD MODE
NINE SUB-FIELDS
256 TONE LEVELS

PLASMA PANEL DISPLAY DEVICE

TECHNICAL FIELD

The present invention relates to display devices, and in particular, to a display device of a plasma display panel (PDP) and a digital micro mirror device (DMD).

BACKGROUND ART

For the display devices of PDP and DMD, there is used a sub-field method employing a binary memory for displaying a motion picture having a halftone by temporally superimposing a plurality of weighted binary images. Although the description below is provided for PDP, the same thing can be said for DMD.

The sub-field method will be described with reference to FIGS. 1, 2 and 3.

As shown in FIG. 3, a PDP having ten pixels arranged laterally by four pixels arranged longitudinally is now considered. The brightness levels of R, G and B of each pixel are each represented in eight bits, allowing the representation of brightness to be achieved with a 256-step gradation. The following description is provided for a G signal unless special comment is given, and the same thing can be said for R and B.

In FIG. 3, a portion indicated by the reference letter A has a brightness signal level of 128. If this is represented in binary digits, then a level signal of (1000 0000) is applied to each pixel in the portion A. Likewise, a portion indicated by the reference letter B has the brightness of 127, and a signal level of (0111 1111) is applied to each pixel in the portion B. A portion indicated by the reference letter C has the brightness of 126, and a signal level of (0111 1110) is applied to each pixel in the portion C. A portion indicated by the reference letter D has the brightness of 125, and a signal level of (0111 1101) is applied to each pixel in the portion D. A portion indicated by the reference letter E has the brightness of 0, and a signal level of (0000 0000) is applied to each pixel in the portion E. Each sub-field is obtained by arranging the 8-bit signals of the pixels in the vertical direction in the respective positions of the pixels and slicing the signal every bit in the horizontal direction. That is, according to an image displaying method using the so-called sub-field method for dividing one field into a plurality of differently weighted binary images and displaying the resulting image by temporally superimposing these binary images, each binary image obtained through the division is referred to as a sub-field.

The signal of each pixel is expressed as eight bits, and therefore, eight sub-fields can be obtained as shown in FIG. 2. A sub-field SF1 is obtained by collecting the least significant bits of the 8-bit signals of the pixels and arranging them in a 10×4 matrix form. A sub-field SF2 is obtained by collecting the second least significant bits and similarly arranging them in a matrix form. According to the above manner, sub-fields SF1, SF2, SF3, SF4, SF5, SF6, SF7 and SF8 are formed. Needless to say, the sub-field SF8 is obtained by collecting the most significant bits and similarly arranging them.

FIG. 4 shows the standard form of a PDP drive signal of one field. As shown in FIG. 4, the standard form of the PDP drive signal has the eight sub-fields SF1, SF2, SF3, SF4, SF5, SF6, SF7 and SF8. The sub-fields SF1 through SF8 are sequentially processed, and the total processing is executed in a period of one field.

The processing of each sub-field will be described with reference to FIG. 4. The processing of each sub-field is comprised of a setup period P1, a addressing period P2, a sustaining period P3 and an erasing period P4. In the setup period P1, a single pulse is applied to a sustaining electrode E0, while a single pulse is each applied also to scanning electrodes E1, E2, E3 and E4 (the reason why only four scanning electrodes are shown in FIG. 4 is that only four scanning lines are shown in the example of FIG. 3 and a number of, for example, 480 scanning lines actually exist). By this operation, set up discharging is executed.

In the addressing period P2, the scanning electrodes in the horizontal direction are successively scanned, and only the pixel in which a data pulse is applied to a data electrode E5 at the timing when a wrinting palse is applied to the scanning electrode is subjected to specified writing. For example, during the processing of the sub-field SF1, the pixel indicated by "1" is subjected to writing and the pixel indicated by "0" is not subjected to writing inside the sub-field SF1 shown in FIG. 2.

In the sustaining period P3, one or more sustaining pulse (drive pulse) corresponding to the weight value of each sub-field is outputted. The pixel that has undergone writing and is indicated by "1" is subjected to plasma discharging in response to each sustaining pulse, and the specified pixel brightness is obtained through one process of plasma discharging. The weight of the sub-field SF1 is "1", and therefore, the brightness of level "1" can be obtained. The weight of the sub-field SF2 is "2", and therefore, the brightness of level "2" can be obtained. That is, the addressing period P2 is a period during which the pixel for emitting light is selected, while the sustaining period P3 is a period during which light emission is executed by the number of times corresponding to the quantity of weighting.

In the erasing period P4, the remaining electric charges are entirely erased.

As shown in FIG. 4, the sub-fields SF1, SF2, SF3, SF4, SF5, SF6, SF7 and SF8 are weighted by 1, 2, 4, 8, 16, 32, 64 and 128, respectively. Therefore, with regard to each pixel, the brightness level can be adjusted in 256 steps ranging from 0 to 255.

In the portion B of FIG. 3, light emission is executed in the sub-fields SF1, SF2, SF3, SF4, SF5, SF6 and SF7, and no light emission is executed in the sub-field SF8. Accordingly, there can be obtained the brightness level of "127" (=1+2+4+8+16+32+64).

In the portion A of FIG. 3, light emission is executed in neither one of the sub-fields SF1, SF2, SF3, SF4, SF5, SF6 and SF7, and light emission is executed in the sub-field SF8. Accordingly, there can be obtained the brightness level of "128".

With regard to the standard form of the PDP drive signal shown in FIG. 4, the PDP drive signal has a variety of modifications, and these modifications will be described below.

FIG. 5 shows a PDP drive signal in a twofold mode. It is to be noted that the PDP drive signal shown in FIG. 4 is in a onefold mode. In the onefold mode of FIG. 4, the number of sustaining pulses included in the sustaining periods P3 of the sub-fields SF1 through SF8, i.e., the weighting values is 1, 2, 4, 8, 16, 32, 64 and 128, respectively. By contrast, in the twofold mode of FIG. 5, the number of sustaining pulses included in the sustaining periods P3 of the sub-fields SF1 through SF8 becomes 2, 4, 8, 16, 32, 64, 128 and 256, respectively, which are doubled in every sub-field. With this arrangement, the PDP drive signal in the twofold mode can display the image with the doubled brightness in contrast to the PDP drive signal of the standard form in the onefold mode.

FIG. 6 shows a PDP drive signal in a threefold mode. Therefore, the number of sustaining pulses included in the sustaining periods P3 of the sub-fields SF1 through SF8 becomes 3, 6, 12, 24, 48, 96, 192 and 384, which are tripled in every sub-field.

As described above, there can be formed a PDP drive signal in a sixfold mode at maximum, also depending on a margin in one field. With this arrangement, the image can be displayed with the sixfold brightness.

It is herein defined that the modal multiple is generally represented as N-fold. This N can also be represented as a weighting multiple N.

FIG. 7A shows the PDP drive signal in the standard form, while FIG. 7B shows a modified PDP drive signal having sub-fields SF1 through SF9 including the one additional sub-field. Although the last sub-field SF8 is weighted by 128 sustaining pulses in the standard form, the last two sub-fields SF8 and SF9 are each weighted with 64 sustaining pulses according to the modification of FIG. 7B. For example, when representing the brightness of the level of 130, the brightness can be obtained by using both the sub-field SF2 (weight of 2) and the sub-field SF8 (weight of 128) in the standard form of FIG. 7A. By contrast, the brightness can be obtained by using the three of the sub-field SF2 (weight of 2), the sub-field SF8 (weight of 64) and the sub-field SF9 (weight of 64) in the modification of FIG. 7B. By thus increasing the number of sub-fields, the weight of the sub-field that is heavily weighted can be reduced without changing the total number of levels of gray scale. By thus reducing the weight, the image display can be made clearer, allowing, for example, the pseudo contour noise to be reduced.

The number of sub-fields is generally represented by Z. In the case of the standard form shown in FIG. 7A, the number Z of the sub-fields is eight, and one pixel is represented in eight bits. In the case of FIG. 7B, the number Z of sub-fields is nine, and one pixel is represented in nine bits. That is, in the case where the number of sub-fields is Z, one pixel is represented in Z bits.

As described above, according to the sub-field method, gray scale representation can be achieved at various levels of brightness by changing the number Z of sub-fields, the weighting multiple N and the quantity of weighting of each sub-field.

However, some of gray scale levels include a pattern in which a plurality of sub-fields that emit no light are continuously existing before the sub-field that should emit light. When providing a gray scale level including the above pattern, the previous sub-fields do not continuously emit light, and therefore, the discharge for writing in the next sub-field that should emit light tends to be temporally delayed. Therefore, it is sometimes the case where no discharge for writing is executed depending on pixels. The sub-field that has undergone no writing has no chance of discharging and emitting light even when a sustaining pulse is subsequently applied after the addressing period. This has consequently led to the disadvantage of the occurrence of pixels that emit no light in a dotted style depending on gray scale levels. The existence of the pixels that emit no light naturally becomes a defect of the displayed image.

In order to solve this problem, it can be considered to satisfactorily execute the writing by setting the pulse width for the discharge for writing wide even if a lag of the discharge for writing occurs. However, if the writing pulse width is expanded in all the sub-fields, then the addressing periods P2 of the sub-fields become long to disadvantageously reduce the number of sub-fields that can exist in one field.

DISCLOSURE OF THE INVENTION

Accordingly, the present invention has the object of providing a display device capable of stably executing discharge for writing without reducing the number of sub-fields in one field.

In order to achieve the above object, the display device of the present invention provides a display device that executes gradational light emission at each pixel every field by forming Z sub-fields of first to Z-th from a video signal in which brightness of each of pixels in one field is represented by Z bits in such a manner that a first sub-field in which zeros and ones obtained by collecting only the first bit of Z bits from the whole screen are arranged is constructed and a second sub-field in which zeros and ones are obtained by collecting only the second bit of Z bits from the whole screen are arranged is constructed, weighting each of the sub-fields and outputting a number of drive pulses N times the given weight or a drive pulse having a time width N times the given weight, the device comprising:

a means for setting a writing pulse width of an attentional light-emitting sub-field wider than a normal writing pulse width at all gray scale levels in the case where at least two continuous non-light-emitting sub-fields exist before the attentional light-emitting sub-field at at least one certain gray scale level among all the gray scale levels specified on the basis of the number Z of sub-fields and the weighting of the sub-fields.

The expanded pulse width of the writing pulse should preferably be about 20 to 80 percent wider, and in particular, about 60 percent wider than the pulse width of the normal writing pulse.

According to the display device of the present invention, the width of the writing pulse may be expanded for the sub-field of which the weight is not smaller than a specified number. In this case, the specified number may be three, five or ten.

The display device of the present invention further comprises:

a time information source that stores time information of the sub-fields within one field for a variety of fields in which at least one of the number Z of sub-fields, the weighting multiple N and the weighting of the sub-fields is different;

a means for selecting an appropriate sub-field time information from the time information source on the basis of at least one of the specified number Z of sub-fields, the specified weighting multiple N and the specified weighting of the sub-fields; and a means for regulating positions of sub-fields arranged within one field according to the selected sub-field time information, whereby the sustaining periods of the sub-fields are arranged approximately in same positions within one field between fields.

BRIEF DESCRIPTION OF THE DRAWINGS

The present invention will be further described with reference to the accompanying drawings wherein like reference numerals refer to like parts in the several views, and wherein:

FIGS. 1A to 1H are explanatory views of individuals of sub-fields SF1 through SF8;

BEST MODE FOR CARRYING OUT THE INVENTION

Figure 2:
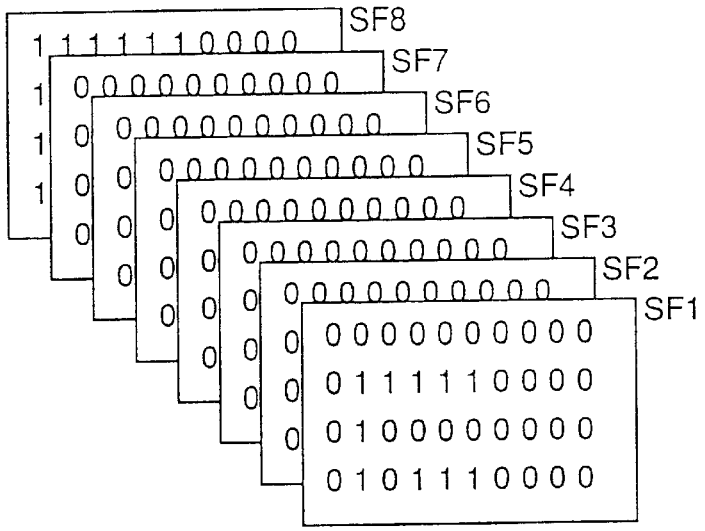
Fig.2 PRIOR ART
FIG. 2 is an explanatory view of a state in which the sub-fields SF1 through SF8 are superimposed on one another.
Figure 3:
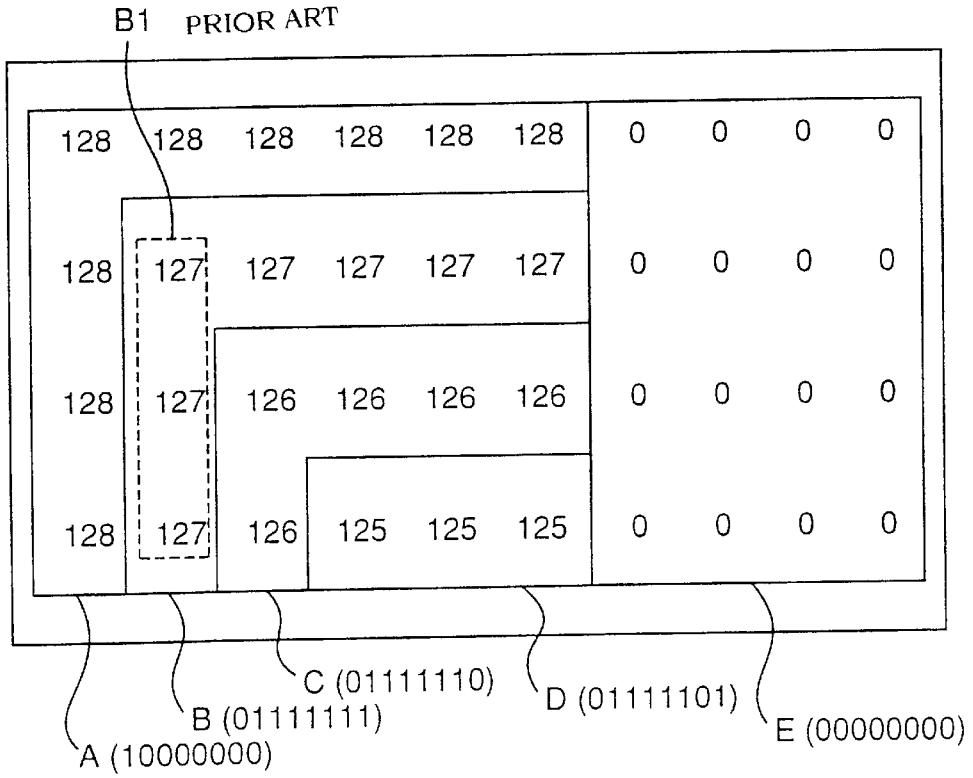
FIG. 3 is an explanatory view showing an example of the brightness distribution of a PDP screen.
Figure 4:
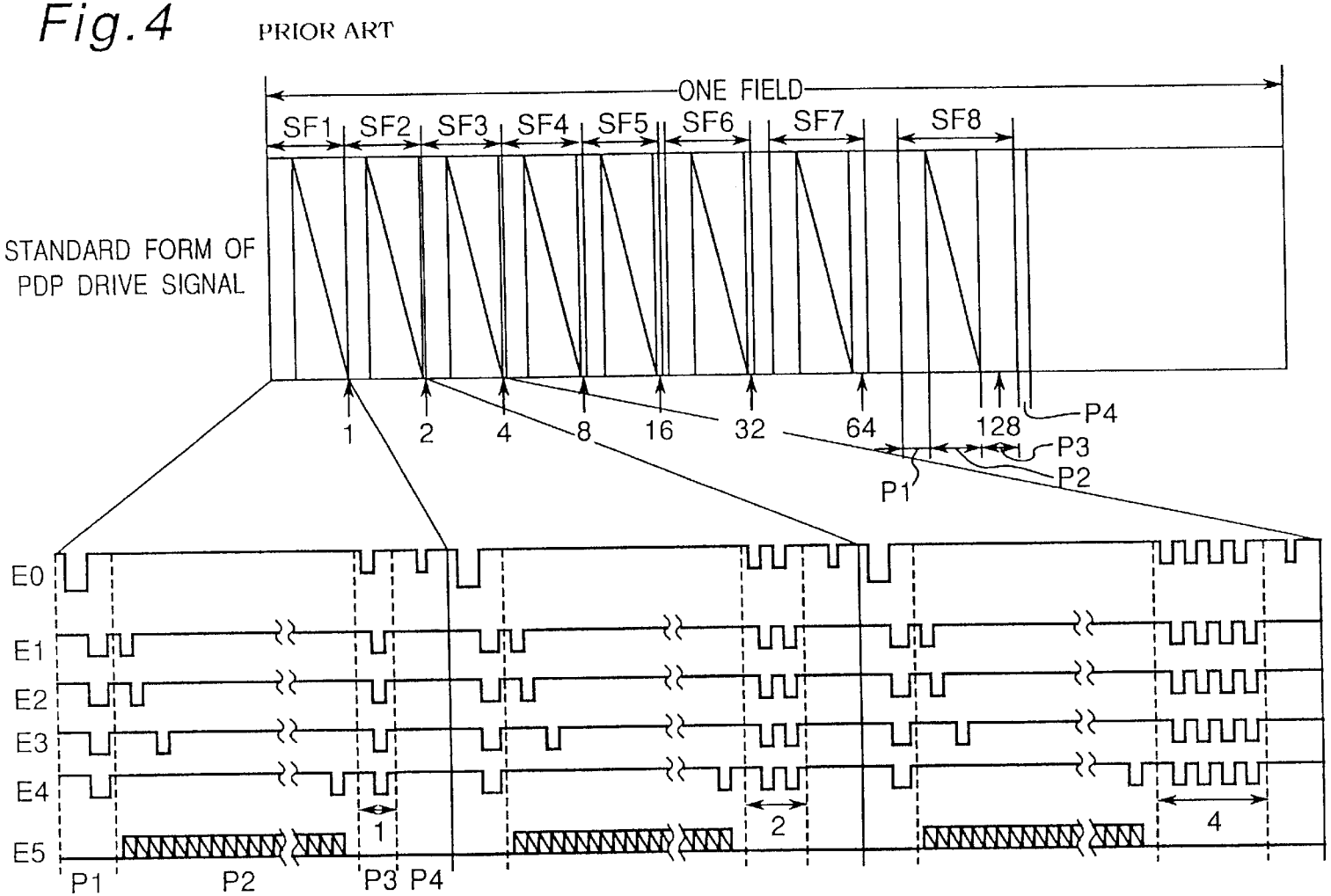
Fig. 4 PRIOR ART
FIG. 4 is a waveform chart showing the standard form of a PDP drive signal.
Figure 5:
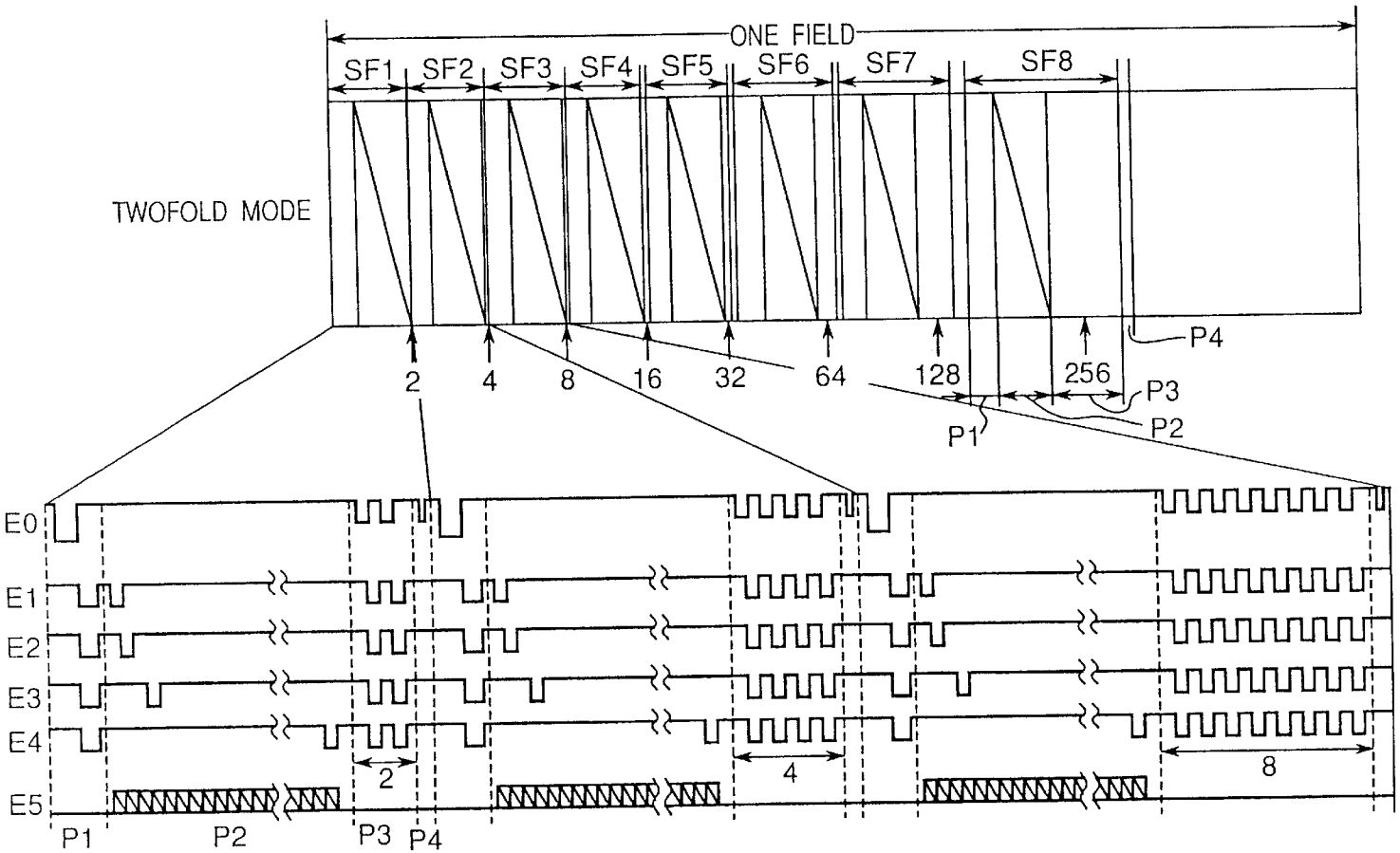
Fig. 5 PRIOR ART
FIG. 5 is a waveform chart showing the twofold mode of the PDP drive signal.
Figure 6:
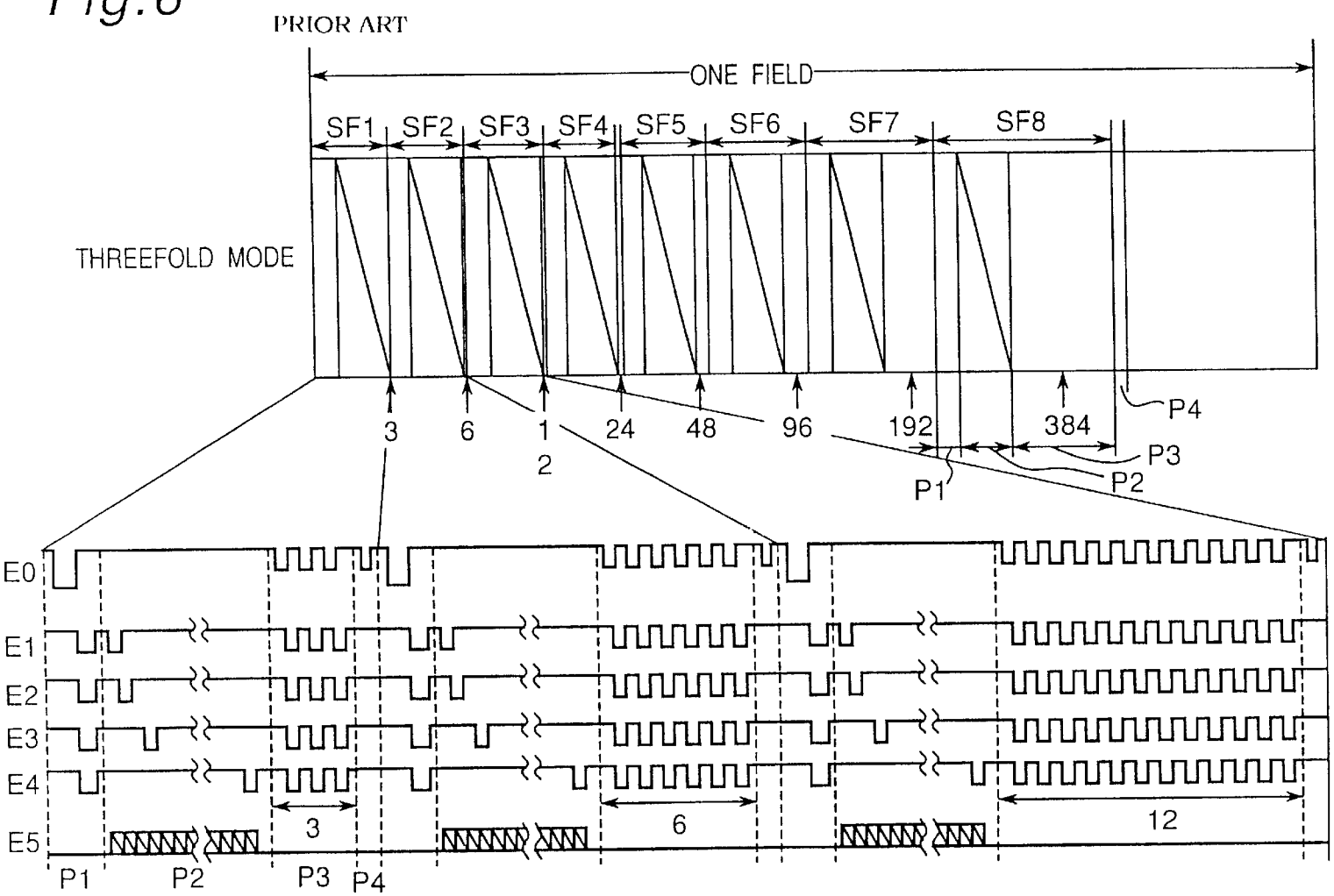
FIG. 6 is a waveform chart showing the threefold mode of the PDP drive signal.
Figure 7A:
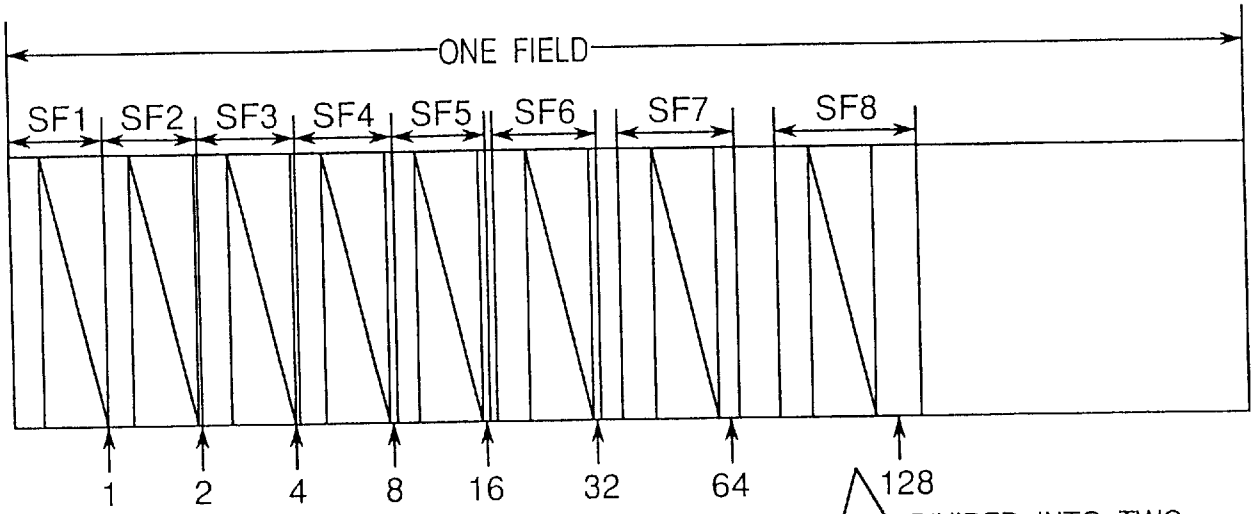
Fig. 7A PRIOR ART
FIG. 7A is a waveform chart of eight sub-fields according to the standard form of the PDP drive signal.
Figure 7B:
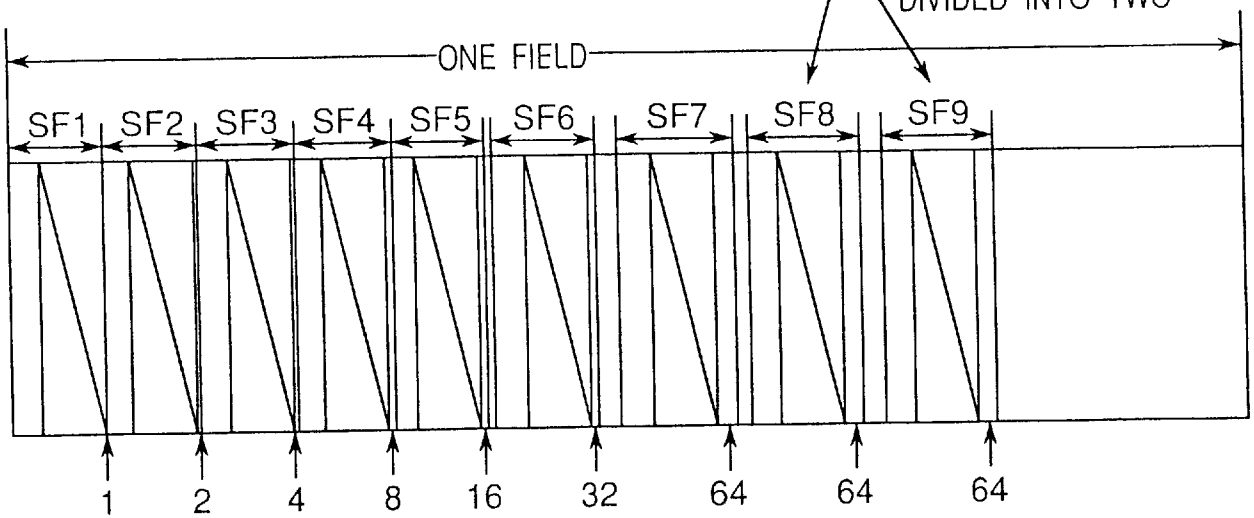
Fig. 7B PRIOR ART
FIG. 7B is a waveform chart of nine sub-fields according to the modification of the PDP drive signal.
Figure 8:
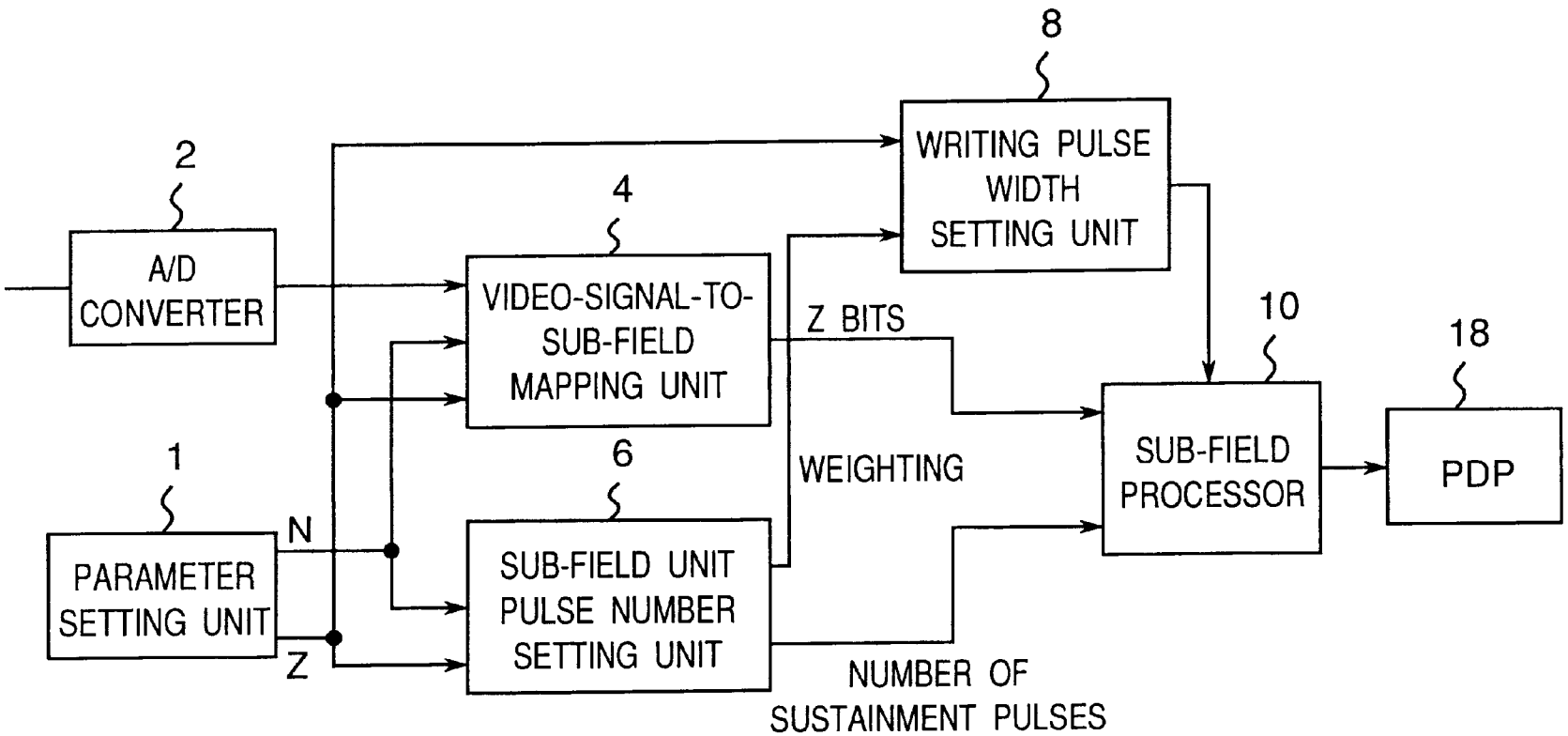
FIG. 8 is a block diagram of a drive pulse control unit to be used for the PDP of the first embodiment.

FIG. 8 shows a drive pulse control unit to be used for the PDP of the first embodiment. In FIG. 8, a parameter setting unit 1 sets a number Z of sub-fields and a weighting multiple N on the basis of various information of brightness and so on. An A/D converter 2 converts an inputted video signal into an 8-bit digital signal. A video-signal-to-sub-field mapping unit 4 receives the number Z of sub-fields and the weighting multiple N and transforms the 8-bit signal transferred from the A/D converter 2 into a Z-bit signal. A sub-field unit pulse number setting unit 6 receives the number Z of sub-fields and the weighting multiple N and specifies the necessary weight and the number of necessary sustaining pulses for each sub-field.

A writing pulse width setting unit 8 receives the number Z of sub-fields and the weight of each sub-field and firstly specifies all the gray scale levels. In this case, it is assumed that, for example, a gray scale pattern as shown in the following Table 1 and Table 2 is specified. In Table 1 and Table 2, there are sub-fields SF1 through SF12, and the sub-fields SF1 through SF12 are weighted by 1, 2, 4, 8, 16, 32, 32, 32, 32, 32, 32 and 32, respectively, allowing the achievement of representation with a 256-step gradation ranging from 0 to 255. According to a method for reading the tables, the marks ○ and ◎ represent the sub-fields in which light emission should be executed by plasma discharge in order to provide the desired gray scale level in a certain attentional pixel. As described later, it is to be noted that the mark ○ represents the case where the writing pulse of the normal width is used and the mark ◎ represents the case where the writing pulse of the expanded pulse width is used. According to Table 1, in order to provide a gray scale level 6, it is proper to make the sub-field SF2 (weight of 2) and the sub-field SF3 (weight of 4) emit light, and therefore, the mark ◎ is entered in the columns of SF2 and SF3. It is to be noted that the frequency of light emission in the sub-field SF2 is two and the frequency of light emission in the sub-field SF3 is four. This means that the light emission is executed six times in total, allowing the gray scale level 6 to be provided. According to Table 2, it is proper to make the sub-fields SF3 (weight of 4), SF6 (weight of 32), SF7 (weight of 32) and SF8 (weight of 32) emit light in order to provide a gray scale level 100. Therefore, the mark ◎ or ○ is entered in the columns of SF3, SF6, SF7 and SF8.

TABLE 1

| | SUB-FIELD | | | | | | | | | | | |
|---|---|---|---|---|---|---|---|---|---|---|---|---|
| GRAY SCALE | SF1 | SF2 | SF3 | SF4 | SF5 | SF6 | SF7 | SF8 | SF9 | SF10 | SF11 | S12 |
| | WEIGHT | | | | | | | | | | | |
| LEVEL | 1 | 2 | 4 | 8 | 16 | 32 | 32 | 32 | 32 | 32 | 32 | 32 |
| 0 | | | | | | | | | | | | |
| 1 | ◎ | | | | | | | | | | | |
| 2 | | ◎ | | | | | | | | | | |
| 3 | ◎ | ◎ | | | | | | | | | | |
| 4 | | | ◎ | | | | | | | | | |
| 5 | ◎ | | ◎ | | | | | | | | | |
| 6 | | ◎ | ◎ | | | | | | | | | |
| 7 | ◎ | ◎ | ◎ | | | | | | | | | |
| 8 | | | | ◎ | | | | | | | | |
| 9 | ◎ | | | ◎ | | | | | | | | |

TABLE 1-continued

| GRAY SCALE | SUB-FIELD | | | | | | | | | | | |
|---|---|---|---|---|---|---|---|---|---|---|---|---|
| | SF1 | SF2 | SF3 | SF4 | SF5 | SF6 | SF7 | SF8 | SF9 | SF10 | SF11 | S12 |
| | WEIGHT | | | | | | | | | | | |
| LEVEL | 1 | 2 | 4 | 8 | 16 | 32 | 32 | 32 | 32 | 32 | 32 | 32 |
| 10 | | ◎ | | ◎ | | | | | | | | |
| 11 | ◎ | ◎ | | ◎ | | | | | | | | |
| 12 | | | ◎ | ◎ | | | | | | | | |
| 13 | ◎ | | ◎ | ◎ | | | | | | | | |
| 14 | | ◎ | ◎ | ◎ | | | | | | | | |
| 15 | ◎ | ◎ | ◎ | ◎ | | | | | | | | |
| 16 | | | | | ◎ | | | | | | | |
| 17 | ◎ | | | | ◎ | | | | | | | |
| 18 | | ◎ | | | ◎ | | | | | | | |
| 19 | ◎ | ◎ | | | ◎ | | | | | | | |
| 20 | | | ◎ | | ◎ | | | | | | | |
| 21 | ◎ | | ◎ | | ◎ | | | | | | | |
| 22 | | ◎ | ◎ | | ◎ | | | | | | | |
| 23 | ◎ | ◎ | ◎ | | ◎ | | | | | | | |
| 24 | | | | ◎ | ◎ | | | | | | | |
| 25 | ◎ | | | ◎ | ◎ | | | | | | | |
| 26 | | ◎ | | ◎ | ◎ | | | | | | | |
| 27 | ◎ | ◎ | | ◎ | ◎ | | | | | | | |
| 28 | | | ◎ | ◎ | ◎ | | | | | | | |
| 29 | ◎ | | ◎ | ◎ | ◎ | | | | | | | |
| 30 | | ◎ | ◎ | ◎ | ◎ | | | | | | | |
| 31 | ◎ | ◎ | ◎ | ◎ | ◎ | | | | | | | |

○ WRITING PULSE OF NORMAL WIDTH
◎ WRITING PULSE OF EXPANDED WIDTH

TABLE 2

| GRAY SCALE | SUB-FIELD | | | | | | | | | | | |
|---|---|---|---|---|---|---|---|---|---|---|---|---|
| | SF1 | SF2 | SF3 | SF4 | SF5 | SF6 | SF7 | SF8 | SF9 | SF10 | SF11 | S12 |
| | WEIGHT | | | | | | | | | | | |
| LEVEL | 1 | 2 | 4 | 8 | 16 | 32 | 32 | 32 | 32 | 32 | 32 | 32 |
| 32 | | | | | | ◎ | | | | | | |
| 33 | ◎ | | | | | ◎ | | | | | | |
| 34 | | ◎ | | | | ◎ | | | | | | |
| 35 | ◎ | ◎ | | | | ◎ | | | | | | |
| 36 | | | ◎ | | | ◎ | | | | | | |
| 37 | ◎ | | ◎ | | | ◎ | | | | | | |
| 38 | | ◎ | ◎ | | | ◎ | | | | | | |
| 39 | ◎ | ◎ | ◎ | | | ◎ | | | | | | |
| 40 | | | | ◎ | | ◎ | | | | | | |
| 41 | ◎ | | | ◎ | | ◎ | | | | | | |
| 42 | | ◎ | | ◎ | | ◎ | | | | | | |
| 43 | ◎ | ◎ | | ◎ | | ◎ | | | | | | |
| 44 | | | ◎ | ◎ | | ◎ | | | | | | |
| 45 | ◎ | | ◎ | ◎ | | ◎ | | | | | | |
| 46 | | ◎ | ◎ | ◎ | | ◎ | | | | | | |
| 47 | ◎ | ◎ | ◎ | ◎ | | ◎ | | | | | | |
| 48 | | | | | ◎ | ◎ | | | | | | |
| 49 | ◎ | | | | ◎ | ◎ | | | | | | |
| 50 | | ◎ | | | ◎ | ◎ | | | | | | |
| 51 | ◎ | ◎ | | | ◎ | ◎ | | | | | | |
| 52 | | | ◎ | | ◎ | ◎ | | | | | | |
| 53 | ◎ | | ◎ | | ◎ | ◎ | | | | | | |
| 54 | | ◎ | ◎ | | ◎ | ◎ | | | | | | |
| 55 | ◎ | ◎ | ◎ | | ◎ | ◎ | | | | | | |
| 56 | | | | ◎ | ◎ | ◎ | | | | | | |
| 57 | ◎ | | | ◎ | ◎ | ◎ | | | | | | |
| 58 | | ◎ | | ◎ | ◎ | ◎ | | | | | | |
| 59 | ◎ | ◎ | | ◎ | ◎ | ◎ | | | | | | |
| 60 | | | ◎ | ◎ | ◎ | ◎ | | | | | | |
| 61 | ◎ | | ◎ | ◎ | ◎ | ◎ | | | | | | |
| 62 | | ◎ | ◎ | ◎ | ◎ | ◎ | | | | | | |
| 63 | ◎ | ◎ | ◎ | ◎ | ◎ | ◎ | | | | | | |
| 64–95 | SAME AS 0–31 | | | | | ◎ | ○ | | | | | |
| 96–127 | SAME AS 0–31 | | | | | ◎ | ○ | ○ | | | | |
| 128–159 | SAME AS 0–31 | | | | | ◎ | ○ | ○ | ○ | | | |

TABLE 2-continued

| GRAY SCALE | SUB-FIELD | | | | | | | | | | | |
|---|---|---|---|---|---|---|---|---|---|---|---|---|
| | SF1 | SF2 | SF3 | SF4 | SF5 | SF6 | SF7 | SF8 | SF9 | SF10 | SF11 | S12 |
| | WEIGHT | | | | | | | | | | | |
| LEVEL | 1 | 2 | 4 | 8 | 16 | 32 | 32 | 32 | 32 | 32 | 32 | 32 |
| 160–191 | SAME AS 0–31 | | | | | ◎ | ○ | ○ | ○ | ○ | | |
| 192–223 | SAME AS 0–31 | | | | | ◎ | ○ | ○ | ○ | ○ | ○ | |
| 224–255 | SAME AS 0–31 | | | | | ◎ | ○ | ○ | ○ | ○ | ○ | ○ |

○ WRITING PULSE OF NORMAL WIDTH
◎ WRITING PULSE OF EXPANDED WIDTH

The writing pulse width setting unit 8 applies the writing pulse of the normal pulse width to the general sub-fields and applies the writing pulse of the expanded pulse width to the selected sub-fields that satisfy a specified condition. The specified condition will be described below.

If neither a certain sub-field previous to an attentional sub-field nor a sub-field further previous to the certain sub-field is emitting light, then it can be considered that the attentional sub-field is not warmed up. In such case, if the writing pulse of the normal width is applied to the attentional sub-field, then it is sometimes the case where no light-emitting discharge is executed. As described above, in the sub-field that is not warmed up, the light-emitting discharge can not be always reliably executed using the writing pulse of the normal width. Therefore, according to the present invention, the writing pulse width is made wider than the normally given width in the sub-field that is possibly not warmed up, allowing the light-emitting discharge to be reliably executed.

The writing pulse width setting unit 8 selects the attentional light-emitting sub-field on the basis of the aforementioned specified condition when two or more non-light-emitting sub-fields continuously exist before the attentional light-emitting sub-field at at least one certain gray scale level among all the specified gray scale levels. In the case of Table 1 and Table 2, gray scale levels 4, 8, 9, 16, 17, 18, 19, 24, 25, 28, 32 and so on correspond to the aforementioned specified condition, and the sub-fields SF3, SF4, SF5 and SF6 are selected. For example, in the case of the gray scale level 8, the sub-field SF4 receives the light emission instruction, whereas neither the sub-field SF3 previous to the sub-field SF4 nor the sub-field SF2 further previous to the sub-field SF3 receives the light emission instruction. Therefore, the sub-field SF4 satisfies the aforementioned specified condition, and the writing pulse of the expanded pulse width is given thereto. The sub-field SF4 does not satisfy the aforementioned specified condition at the gray scale levels 10, 11 and so on but satisfies the specified condition at the gray scale levels 8 and 9. Therefore, the sub-field SF4 is selected by the writing pulse width setting unit 8.

The gray scale levels 1 and 2 satisfy the aforementioned specified condition since it is possible that the last sub-field and the last sub-field but one of the preceding field do not emit light, and therefore, the sub-fields SF1 and SF2 are also selected by the writing pulse width setting unit 8. Then, the writing pulse width setting unit 8 outputs a signal to the sub-field processor 10 so as to set the writing pulse width of these selected fields wider than the normal writing pulse width at all the gray scale levels. Therefore, in the case of Table 1 and Table 2, the writing pulse widths of the sub-fields SF1, SF2, SF3, SF4, SF5 and SF6 are to be expanded. In this case, the pulse width of the expanded writing pulse is made about 20 to 80 percent wider, and preferably, about 60 percent wider than the pulse width of the normal writing pulse. Specifically, the pulse width of the normal writing pulse is, for example, 2.5 $\mu$sec, and the pulse width of the expanded writing pulse is, for example, 4 $\mu$sec.

As shown below in the Table 3 which is an another example, if the number Z of sub-fields is 10 and the weights of the sub-fields SF1 through SF10 are 1, 2, 4, 8, 16, 25, 34, 44, 55 and 66, respectively, and the total number of gray scale levels is 256, then the gray scale levels 1, 2, 4, 8, 9, 12, 16, 17, 18, 19, 20, 24, 25, 28 and 32 satisfy the aforementioned specified condition. Therefore, the writing pulse width setting unit 8 selects the sub-fields SF1, SF2, SF3, SF4, SF5 and SF6 and outputs a signal to the sub-field processor 10 so as to expand the writing pulse width of these sub-fields.

TABLE 3

| GRAY SCALE | SUB-FIELD | | | | | | | | | |
|---|---|---|---|---|---|---|---|---|---|---|
| | SF1 | SF2 | SF3 | SF4 | SF5 | SF6 | SF7 | SF8 | SF9 | SF10 |
| | WEIGHT | | | | | | | | | |
| LEVEL | 1 | 2 | 4 | 8 | 16 | 25 | 34 | 44 | 55 | 66 |
| 0 | | | | | | | | | | |
| 1 | ◎ | | | | | | | | | |
| 2 | | ◎ | | | | | | | | |
| 3 | ◎ | ◎ | | | | | | | | |
| 4 | | | ◎ | | | | | | | |
| 5 | ◎ | | ◎ | | | | | | | |
| 6 | | ◎ | ◎ | | | | | | | |
| 7 | ◎ | ◎ | ◎ | | | | | | | |

TABLE 3-continued

| GRAY SCALE | SUB-FIELD | | | | | | | | | |
|---|---|---|---|---|---|---|---|---|---|---|
| | SF1 | SF2 | SF3 | SF4 | SF5 | SF6 | SF7 | SF8 | SF9 | SF10 |
| | WEIGHT | | | | | | | | | |
| LEVEL | 1 | 2 | 4 | 8 | 16 | 25 | 34 | 44 | 55 | 66 |
| 8 | | | | ◎ | | | | | | |
| 9 | ◎ | | | ◎ | | | | | | |
| 10 | | ◎ | | ◎ | | | | | | |
| 11 | ◎ | ◎ | | ◎ | | | | | | |
| 12 | | | ◎ | ◎ | | | | | | |
| 13 | ◎ | | ◎ | ◎ | | | | | | |
| 14 | | ◎ | ◎ | ◎ | | | | | | |
| 15 | ◎ | ◎ | ◎ | ◎ | | | | | | |
| 16 | | | | | ◎ | | | | | |
| 17 | ◎ | | | | ◎ | | | | | |
| 18 | | ◎ | | | ◎ | | | | | |
| 19 | ◎ | ◎ | | | ◎ | | | | | |
| 20 | | | ◎ | | ◎ | | | | | |
| 21 | ◎ | | ◎ | | ◎ | | | | | |
| 22 | | ◎ | ◎ | | ◎ | | | | | |
| 23 | ◎ | ◎ | ◎ | | ◎ | | | | | |
| 24 | | | | ◎ | ◎ | | | | | |
| 25 | ◎ | | | ◎ | ◎ | | | | | |
| 26 | | ◎ | | ◎ | ◎ | | | | | |
| 27 | ◎ | ◎ | | ◎ | ◎ | | | | | |
| 28 | | | ◎ | ◎ | ◎ | | | | | |
| 29 | ◎ | | ◎ | ◎ | ◎ | | | | | |
| 30 | | ◎ | ◎ | ◎ | ◎ | | | | | |
| 31 | ◎ | ◎ | ◎ | ◎ | ◎ | | | | | |
| 32 | ◎ | ◎ | ◎ | | | ◎ | | | | |
| 33–56 | SAME AS 8–31 | | | | | ◎ | | | | |
| 57 | ◎ | ◎ | ◎ | | ◎ | | ○ | | | |
| 58–90 | SAME AS 24–56 | | | | | | ○ | | | |
| 91 | | ◎ | ◎ | | ◎ | ◎ | | ○ | | |
| 92–134 | SAME AS 48–90 | | | | | | | ○ | | |
| 135 | ◎ | | ◎ | | ◎ | ◎ | ○ | | ○ | |
| 136–189 | SAME AS 81–134 | | | | | | | | ○ | |
| 190 | ◎ | | ◎ | | ◎ | ◎ | ○ | ○ | | ○ |
| 191–255 | SAME AS 125–189 | | | | | | | | | ○ |

○ WRITING PULSE OF NORMAL WIDTH
◎ WRITING PULSE OF EXPANDED WIDTH

According to the present embodiment, in the case where at least two continuous non-light-emitting sub-fields possibly exist before the attentional light-emitting sub-field, the writing pulse width setting unit 8 selects the attentional light-emitting sub-field. However, it is acceptable to select the attentional light-emitting sub-field in the case where at least three continuous non-light-emitting sub-fields exist before the attentional light-emitting sub-field. Under this condition, the sub-field SF6 is not selected in the case of Table 3. Therefore, the writing pulse of the normal width is used for the sub-field SF6 of Table 3. However, despite the fact that the two non-light-emitting sub-fields SF4 and SF5 continue before the light-emitting sub-field SF6 at the gray scale level 32, the sub-field SF6 has a low probability that a writing error occurs in the sub-field SF6 and little bad influence is exerted on the displayed video image.

Figure 9A:
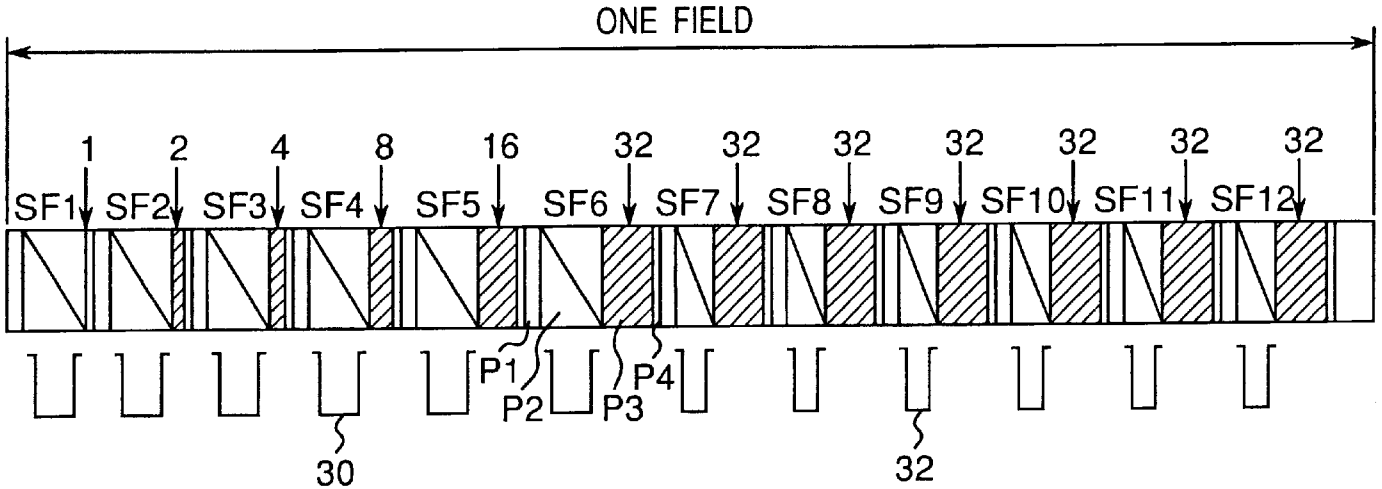
FIG. 9A is a chart showing the drive signal of one field comprised of 12 sub-fields in the case where a wide writing pulse is used for the sub-fields SF1 through SF6 and a normal-width writing pulse is used for the other sub-fields.
Figure 9B:
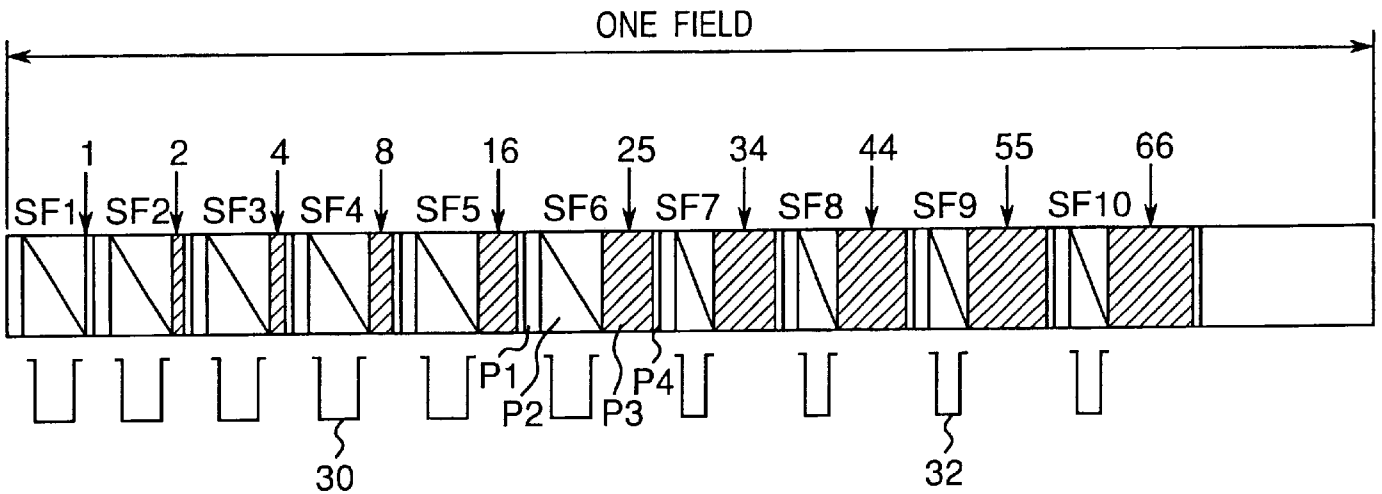
FIG. 9B is a chart showing the drive signal of one field comprised of 10 sub-fields in the case where a wide writing pulse is used for the sub-fields SF1 through SF6 and a normal-width writing pulse is used for the other sub-fields.

The sub-field processor 10 arranges a setup period P1 (300 μsec, for example) at the head of each sub-field, and then arranges a addressing period P2 next to it. During this addressing period P2, according to the case of Table 1 and Table 2, a wide writing pulse 30 is used for the sub- fields SF1 through SF6 and a normal narrow writing pulse 32 is used for the sub-fields SF7 through SF12 on the basis of the signal from the writing pulse width setting unit 8 as shown in FIG. 9A. In the case of Table 3, the wide writing pulse 30 is used for the sub-fields SF1 through SF6 and the normal narrow writing pulse 32 is used for the sub-fields SF7 through SF10 on the basis of the signal from the writing pulse width setting unit 8 as shown in FIG. 9B. Then, the sub-field processor 10 arranges a sustaining period P3 next to the addressing period P2, and a number of sustaining pulses (of which a cycle corresponding to one gray scale step is, for example, 20 μsec) determined by the sub-field unit pulse number setting unit 6 are applied during this sustaining period P3. Then, an erasing period P4 (40 μsec, for example) is arranged at the tail of each sub-field.

The thus-formed PDP drive signal is inputted to the plasma display panel 18 and used for the display of the video image.

It is to be noted that the parameter setting unit 1, A/D converter 2, video-signal-to-sub-field mapping unit 4, sub-field unit pulse number setting unit 6 and sub-field processor 10 are disclosed in detail in the specification of another Japanese Patent Application No. HEI 10-271030 (title of the invention: display device capable of regulating the number of sub-fields by brightness) filed by the same applicant as that of the present application.

As described above, according to the drive pulse control unit of the PDP of the present embodiment, the writing pulse width is expanded for the sub-fields in which the writing error tends to occur than in the normal case, and this allows the writing to be reliably executed. As a result, neither non-light-emitting sub-field nor pixel occurs at any gray scale level, allowing the gray scale representation to be satisfactorily executed. Furthermore, the wide writing pulse is used only for the sub-fields in which the writing error tends to occur. Therefore, the number of sub-fields that can be provided within one field is not reduced in contrast to the case where the wide writing pulse is used for all the sub-fields.

Figure 10A:
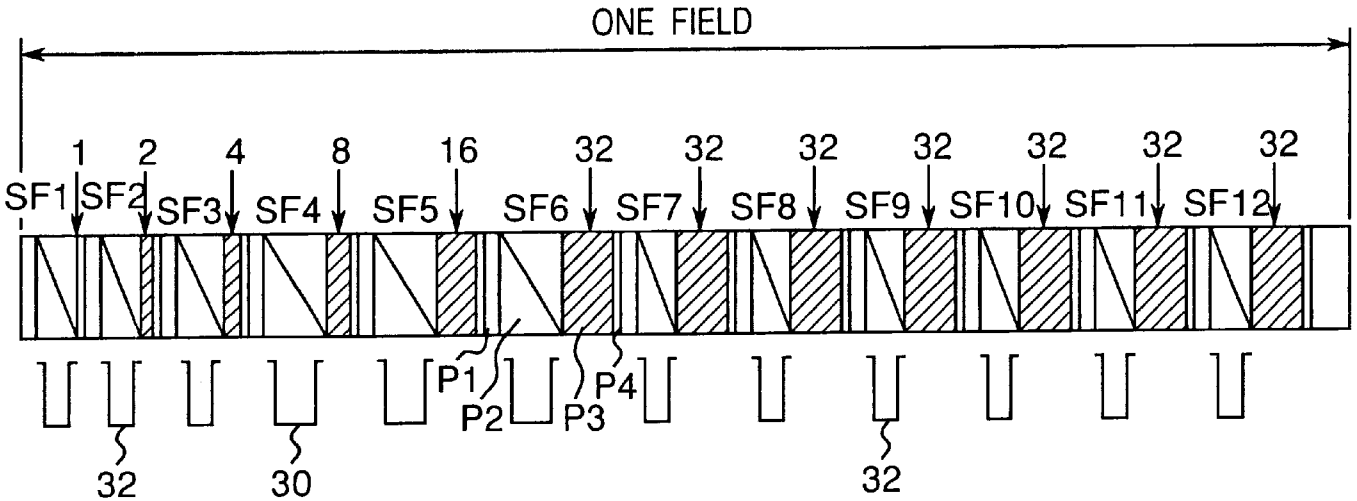
FIG. 10A is a chart showing the drive signal of one field comprised of 12 sub-fields in the case where a wide writing pulse is used for the sub-fields SF4 through SF6 and a normal-width writing pulse is used for the other sub-fields.
Figure 10B:
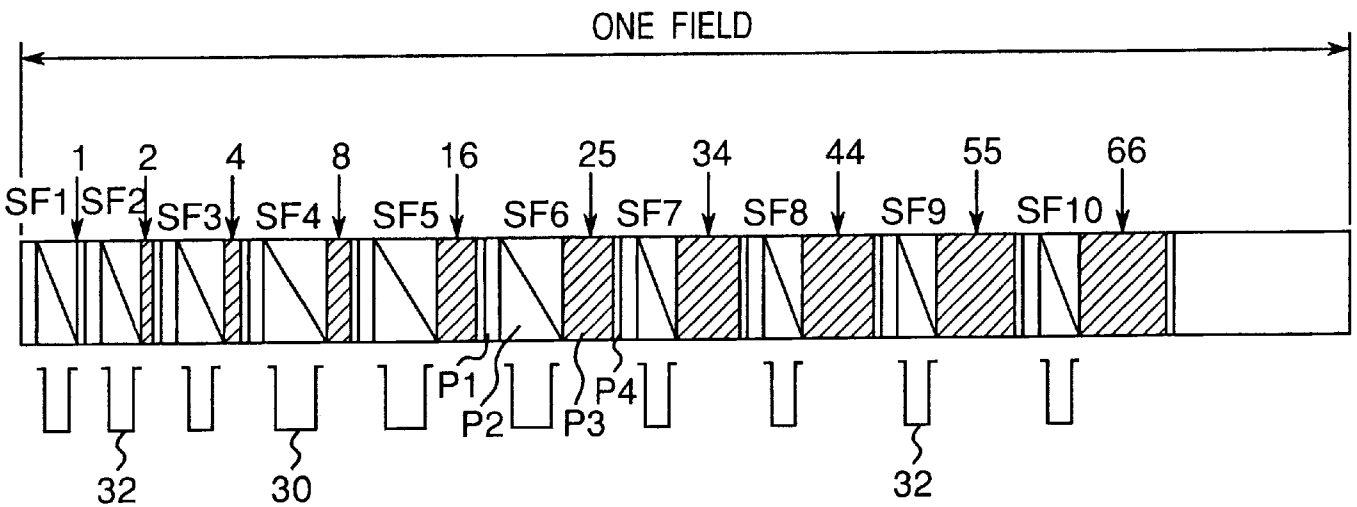
FIG. 10B is a chart showing the drive signal of one field comprised of 10 sub-fields in the case where a wide writing pulse is used for the sub-fields SF4 through SF6 and a normal-width writing pulse is used for the other sub-fields.

According to the above description, the wide writing pulse 30 is used for the sub-fields SF1 through SF6 in either case of Tables 1, 2 and Table 3. However, as shown in FIGS. 10A and 10B, the wide writing pulse 30 may be used only for the sub-fields SF4, SF5 and SF6 of which the weight is more than a specified number (five in this case). The above specified number may be, for example, "2", "3" or "10". The reason for the above is that the sub-fields SF1, SF2, SF3, SF4 and so on, which are relatively lightly weighted and have a small light-emitting frequency, exert little influence on the gray scale representation even if the writing error occurs and light emission is not executed. It is also acceptable to use the wide writing pulse 30 only for one sub-field SF6 with the aforementioned specified number set to, for example, "17".

Although the gray scale levels of 12 or 10 sub-fields that are weighted in the onefold mode in which the weighting multiple N is one are shown in Table 1, Table 2 and Table 3, the drive pulse control unit of the present embodiment can also be applied to gray scale representation provided by a drive signal in the twofold mode or the threefold mode and to gray scale representation provided by a drive signal in either an integral multiple mode or a decimal-point-including multiple mode. The drive signal in the decimal-point-including multiple mode in which the weighting multiple N includes a decimal point is disclosed in detail in the specification of another Japanese Patent Application No. HEI 10-271995 (title of the invention: drive pulse control unit for PDP display) filed by the same applicant as that of the present application.

The drive pulse control unit to be used for the display device of the second embodiment will be described next.

The video image displayed on the plasma display panel varies in brightness every moment at each pixel. Accordingly, it is highly possible that the drive pulse for making a pixel emit light might vary in terms of the number Z of sub-fields, the weighting multiple N and the quantity of weighting between adjacent fields. In such a case, the following problem sometimes occurs when the wide writing pulse is used for the specified fields, as described above in connection with the aforementioned first embodiment.

Figure 11:
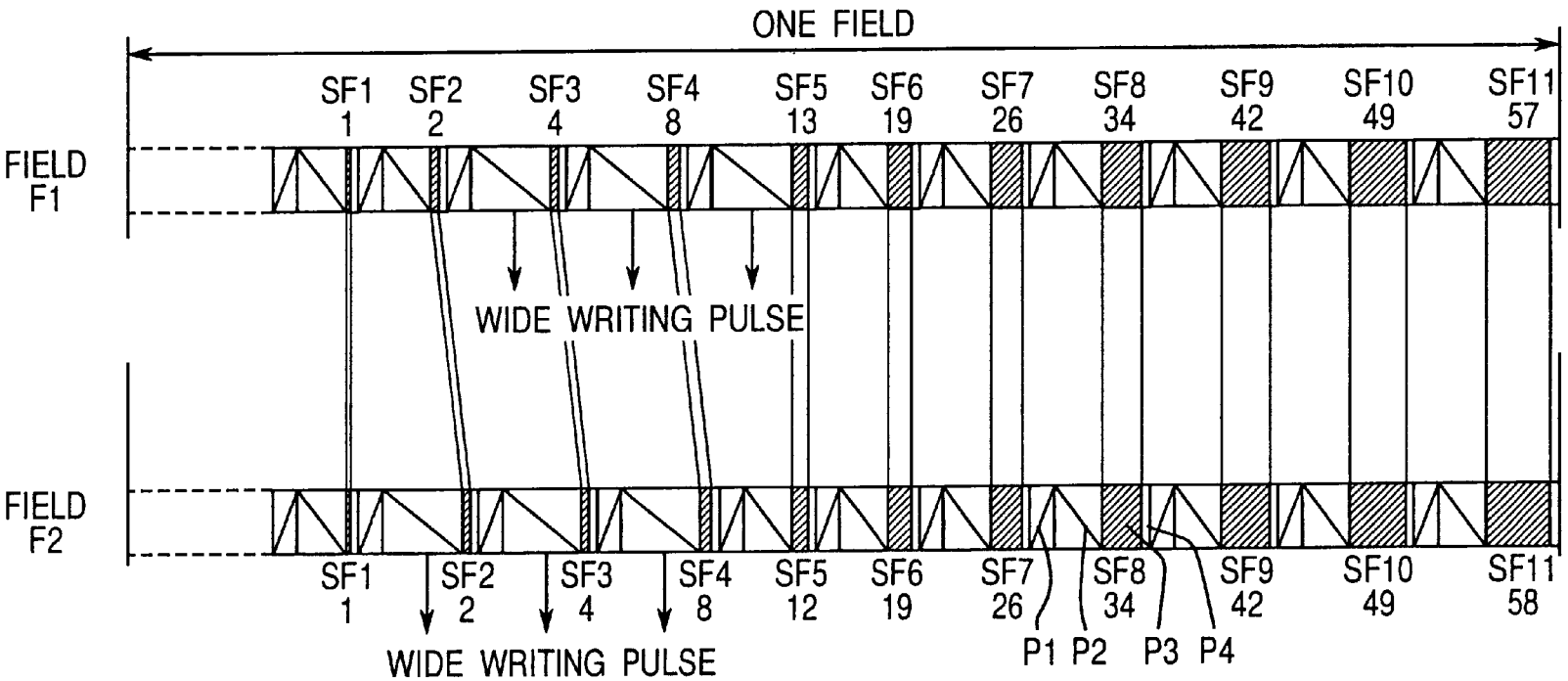
FIG. 11 is a view showing a state in which the light-emitting positions in the sub-fields of the same number shift with respect to each other between two fields in which the sub-fields that use the wide writing pulse differ from each other.

For example, as shown in FIG. 11, there is considered the case where the field F2 succeeds the field F1. The field F1 is constructed of 11 sub-fields SF1 through SF11, and the sub-fields SF1 through SF11 are weighted by 1, 2, 4, 8, 13, 19, 26, 34, 42, 49 and 57, respectively. In contrast to this, the field F2 is also constructed of 11 sub-fields SF1 through SF11, and the sub-fields SF1 through SF11 are weighted by 1, 2, 4, 8, 12, 19, 26, 34, 42, 49 and 58, respectively. Therefore, the sub-fields SF5 and SF11 are differently weighted in the field F1 and the field F2. That is, in contrast to the fact that the weights of the sub-fields SF5 and SF11 of the field F1 are 13 and 57, respectively, the weights of the sub-fields SF5 and SF11 of the field F2 are 12 and 58, respectively.

Due to the above difference in weighting, there are cases where the sub-fields that is applied with the wide writing pulse vary between a certain field and a succeeding field. For example, as shown in FIG. 11, the wide writing pulse is used for the sub-fields SF3, SF4 and SF5 of the field F1, whereas the wide writing pulse is used for the sub-fields SF2, SF3 and SF4 of the field F2. Thus, if the sub-fields for which the wide writing pulse is used differ between an image and the next image that succeeds the image, the position (i.e., the light-emitting position) of the sustaining period P3 of each sub-field within one field is partially shifted. Specifically, as shown in FIG. 11, the positions of the sustaining periods P3 of the sub-fields SF2, SF3 and SF4 are shifted within one field by comparison between the field F1 and the field F2.

Tables 4A–4C below show this positional shift on the time base. Table 4A is a table of the start time and the light emission start time of each sub-field of the field F1. Table 4B is a table of the start time and the light emission start time of each sub-field of the field F2. Table 4C is a table of a light emission start time difference between the field F1 and the field F2. The numerical values in each table are in microseconds, and each start time is calculated from the field start point. Tables 4A–4C show an example obtained by setting one field period Ft to 16667 μsec, setting the setup period P1 of each sub-field field to 300 μsec, setting the addressing period P2 with the writing pulse of the normal width to 600 μsec, setting the addressing period P2 with the wide writing pulse to 900 μsec, setting the cycle of one gray scale step of the sustaining pulse in the sustaining period P3 to 20 μsec and setting the erasing period P4 to 40 μsec.

TABLE 4

| | SUB-FIELD | | | | | | | | | | |
|---|---|---|---|---|---|---|---|---|---|---|---|
| | SF1 | SF2 | SF3 | SF4 | SF5 | SF6 | SF7 | SF8 | SF9 | SF10 | SF11 |
| | FIELD F1 | | | | | | | | | | |
| | WEIGHT | | | | | | | | | | |
| | 1 | 2 | 4 | 8 | 13 | 19 | 26 | 34 | 42 | 49 | 58 |
| SF START TIME | 326.67 | 1286.7 | 2266.7 | 3586.7 | 4986.7 | 6486.7 | 7806.7 | 9266.7 | 10887 | 12667 | 14587 |
| LIGHT EMISSION START TIME | 1226.7 | 2186.7 | 3466.7 | 4786.7 | 6186.7 | 7386.7 | 8706.7 | 10167 | 11787 | 13567 | 15487 |

TABLE 4-continued

| | SUB-FIELD | | | | | | | | | | |
|---|---|---|---|---|---|---|---|---|---|---|---|
| | SF1 | SF2 | SF3 | SF4 | SF5 | SF6 | SF7 | SF8 | SF9 | SF10 | SF11 |
| | FIELD F2 | | | | | | | | | | |
| | WEIGHT | | | | | | | | | | |
| | 1 | 2 | 4 | 8 | 12 | 19 | 26 | 34 | 42 | 49 | 58 |
| SF START TIME | 326.67 | 1286.7 | 2566.7 | 3886.7 | 5286.7 | 6466.7 | 7786.7 | 9246.7 | 10867 | 12647 | 14567 |
| LIGHT EMISSION START TIME | 1226.7 | 2486.7 | 3766.7 | 5086.7 | 6186.7 | 7366.7 | 8686.7 | 10147 | 11767 | 13547 | 15457 |
| LIGHT EMISSION START TIME DIFFERENCE | 0 | 300 | 300 | 300 | 0 | −20 | −20 | −20 | −20 | −20 | −20 |

As is apparent from Tables 4A–4C, the light emission start times of the sub-fields SF2, SF3 and SF4 of the field F2 are delayed by 300 μsec relative to those of the field F1. As shown in Table 4C, the light emission start times of the sub-fields SF6 through SF11 of the field F2 are advanced by 20 μsec relative to those of the field F1. This is because the weight (the number of sustaining pulses) 12 of the sub-field SF5 of the field F2 is smaller by one than the weight (the number of sustaining pulses) 13 of the sub-field SF5 of the field F1, and therefore, the start times and the light emission start times of the sub-fields SF6 through SF11 of the field F2 are advanced by 20 μsec corresponding to the cycle of one sustaining pulse. It is to be noted that the time lag of about 20 μsec is utterly ignorable in terms of the influence exerted on the displayed video image.

As described above, the video image displayed by the sequence of the field F1 and the field F2 in which the sub-fields of the same number have different light emission start times within one field disadvantageously gives a sense of an unnatural change in brightness to the eyes of the viewer due to a disturbance caused by a deviation in light emission cycle of the sub-field of the same number from the one field period.

Figure 12:
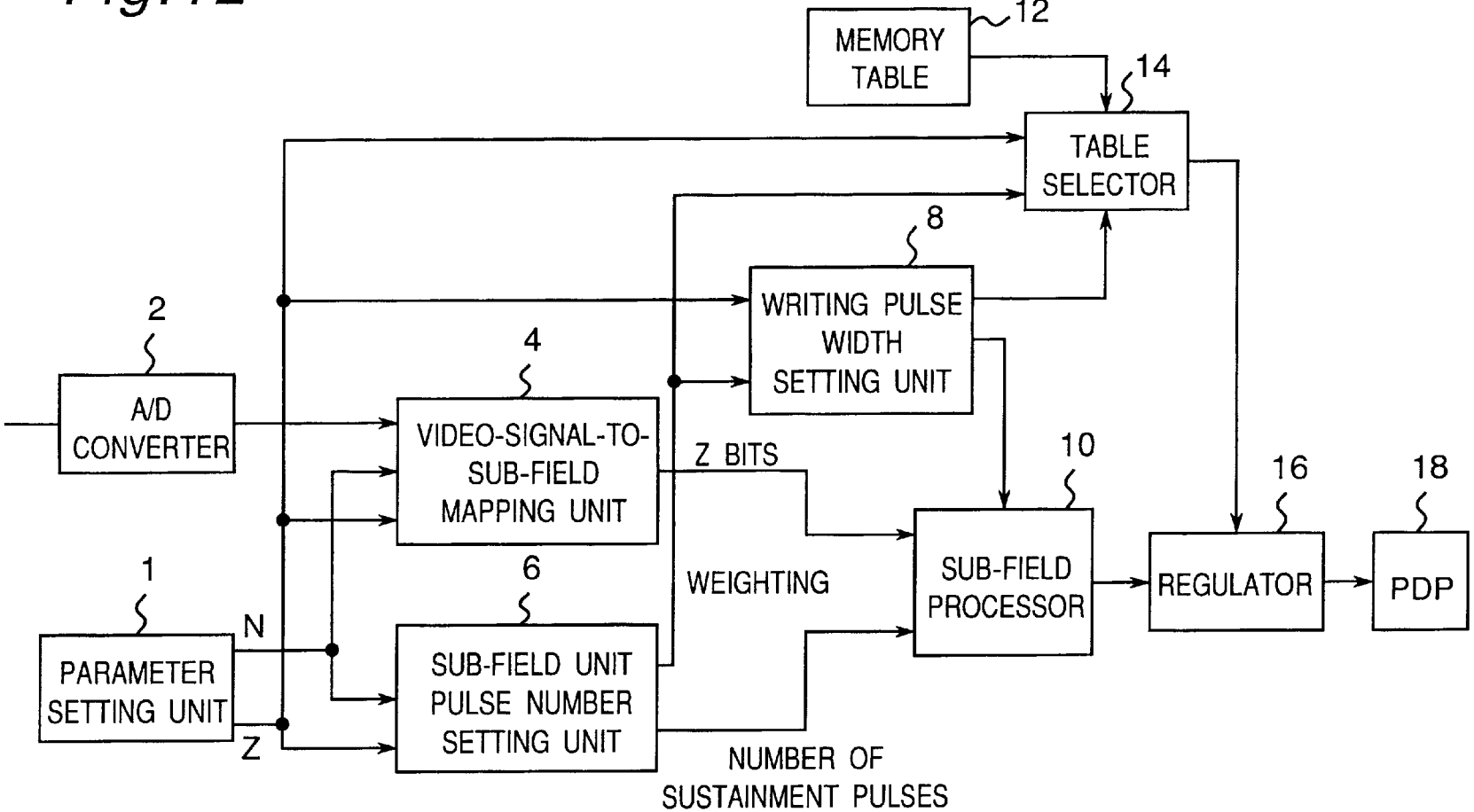
FIG. 12 is a block diagram of a drive pulse control unit to be used for the PDP of the second embodiment.

Accordingly, as shown in FIG. 12, the drive pulse control unit of the second embodiment is provided with a memory table 12, a table selector 14 and a regulator 16 in addition to the circuit construction shown in FIG. 8. The memory table 12 stores plenty of tables (for example, Tables 5A and 5B shown below) including the start time of each sub-field of a variety of fields in which at least one of the number Z of sub-fields, the weighting multiple N and the quantity of weighting of each sub-field varies. The table selector 14 receives the number Z of sub-fields from the parameter setting unit 1, the weight of each sub-field from the sub-field unit pulse number setting unit 6 and the information indicating which sub-field the wide writing pulse is used for from the writing pulse width setting unit 8 and selects the appropriate table from the memory table 12. For example, Table 5A below is selected for the field F1, and Table 5B is selected for the field F2. It is to be noted that the table selector 14 is not always required to adopt all the three items of the number Z of sub-fields, the weight of each sub-field and the information indicating which sub-field the wide writing pulse is used for as criteria for selecting the table and is allowed to use one or two of them as criteria for selecting the table.

TABLE 5

| | SUB-FIELD | | | | | | | | | | |
|---|---|---|---|---|---|---|---|---|---|---|---|
| | SF1 | SF2 | SF3 | SF4 | SF5 | SF6 | SF7 | SF8 | SF9 | SF10 | SF11 |
| | FIELD F1 | | | | | | | | | | |
| | WEIGHT | | | | | | | | | | |
| | 1 | 2 | 4 | 8 | 13 | 19 | 26 | 34 | 42 | 49 | 57 |
| SF START TIME | 26.667 | 1286.7 | 2266.7 | 3586.7 | 4986.7 | 6486.7 | 7806.7 | 9266.7 | 10887 | 12667 | 14587 |
| LIGHT EMISSION START TIME | 926.67 | 2186.7 | 3466.7 | 4786.7 | 6186.7 | 7386.7 | 8706.7 | 10167 | 11787 | 13567 | 15487 |
| | FIELD F2 | | | | | | | | | | |
| | WEIGHT | | | | | | | | | | |
| | 1 | 2 | 4 | 8 | 12 | 19 | 26 | 34 | 42 | 49 | 58 |
| SF START TIME | 26.667 | 986.67 | 2266.7 | 3586.7 | 5286.7 | 6466.7 | 7786.7 | 9246.7 | 10867 | 12647 | 14567 |
| LIGHT EMISSION START TIME | 926.67 | 2186.7 | 3466.7 | 4786.7 | 6186.7 | 7366.7 | 8686.7 | 10147 | 11767 | 13547 | 15467 |

TABLE 5-continued

| | SUB-FIELD | | | | | | | | | | |
|---|---|---|---|---|---|---|---|---|---|---|---|
| | SF1 | SF2 | SF3 | SF4 | SF5 | SF6 | SF7 | SF8 | SF9 | SF10 | SF11 |
| LIGHT EMISSION START TIME DIFFERENCE | 0 | 0 | 0 | 0 | 0 | −20 | −20 | −20 | −20 | −20 | −20 |

Tables 5A, 5B and 5C include the same contents as those of Tables 4A, 4B and 4C, respectively. The numerical values in each table are in microseconds, and each start time is calculated from the field start point. Tables 5A–5C show an example obtained by setting one field period Ft to 16667 μsec, setting the setup period P1 of each sub-field to 300 μsec, setting the addressing period P2 with the writing pulse of the normal width to 600 μsec, setting the addressing period P2 with the wide writing pulse to 900 μsec, setting the cycle of one gray scale step of the sustaining pulse in the sustaining period P3 to 20 μsec and setting the erasing period P4 to 40 μsec, similarly to Tables 4A, 4B and 4C.

It is to be noted that the sub-field start time of Table 5A is regulated by inserting an adjustment time of 300 μsec between the sub-fields SF1 and SF2, while the sub-field start time of Table 5B is regulated by inserting an adjustment time of 300 μsec between the sub-fields SF4 and SF5. With this arrangement, although a time difference of 300 μsec of the light emission start time exists between the sub-fields SF2, SF3 and SF4 of the field F1 and the field F2 as shown in Table 4C before the regulation, the light emission start time difference between the sub-fields SF2, SF3 and SF4 of the field F1 and the field F2 is canceled through the regulation achieved by inserting the adjustment time of 300 μsec between the sub-fields as shown in Table 5C.

The various tables including Tables 5A and 5B which are stored in the memory table 12 are obtained from the following calculation.

A time T necessary for driving all the sub-fields within one field (i.e., a period from the start point of the first sub-field to the end point of the last sub-field) is expressed by the following equation (1).

$$T=(P1+P4)\times SF+\Sigma f(SF)\times P3+P2L\times SFL+P2S\times SFS+AT \quad (1)$$

P1: setup period

P2L: addressing period with wide pulse

P2S: addressing period with normal pulse

P3: cyclical period of one gray scale step of sustaining pulse

P4: erasing period

AT: timing adjustment time

Σf (SF)×P3: sum total of sustaining periods of all sub-fields

SFL: the number of addressing periods with wide pulse

SFS: the number of addressing periods with normal pulse

SF: the number of all sub-fields (SF=SFL+SFS)

By using the time T necessary for driving all the sub-fields obtained according to the above equation (1) and taking the timing adjustment time AT into consideration, a start time tSFn of each sub-field within one field is obtained according to the following equation (2). Then, by adding the setup period P1 and the addressing period P2 to the start time tSFn of each sub-field, the light emission start time of each sub-field is obtained.

$$tSFn=Ft-T+\Sigma sf(SFn-1)+f(AT)SFn \quad (2)$$

Ft: one field period (16667 μsec, for example)

Σsf(SFn−1): total time of the periods of setup, writing, sustaining and erasing from SF1 to SFn-1 (the addressing period of SF3 to SF5 becomes P2L and the other SF addressing period becomes P2S in the case of the field F1 of Table 5A, while the addressing period of SF2 to SF4 becomes P2L and the other SF addressing period becomes P2S in the case of the field F2 of Table 5B.)

f(AT)SFn: timing adjustment time (this time becomes "0 μsec" in SF1 and becomes "300 μsec" in SF2 to SF11 in the case of the field F1 of Table 5A or becomes "0 μsec" in SF1 to SF4 and becomes "300 μsec" in SF5 to SF11 in the case of the field F2 of Table 5B.)

Figure 13:
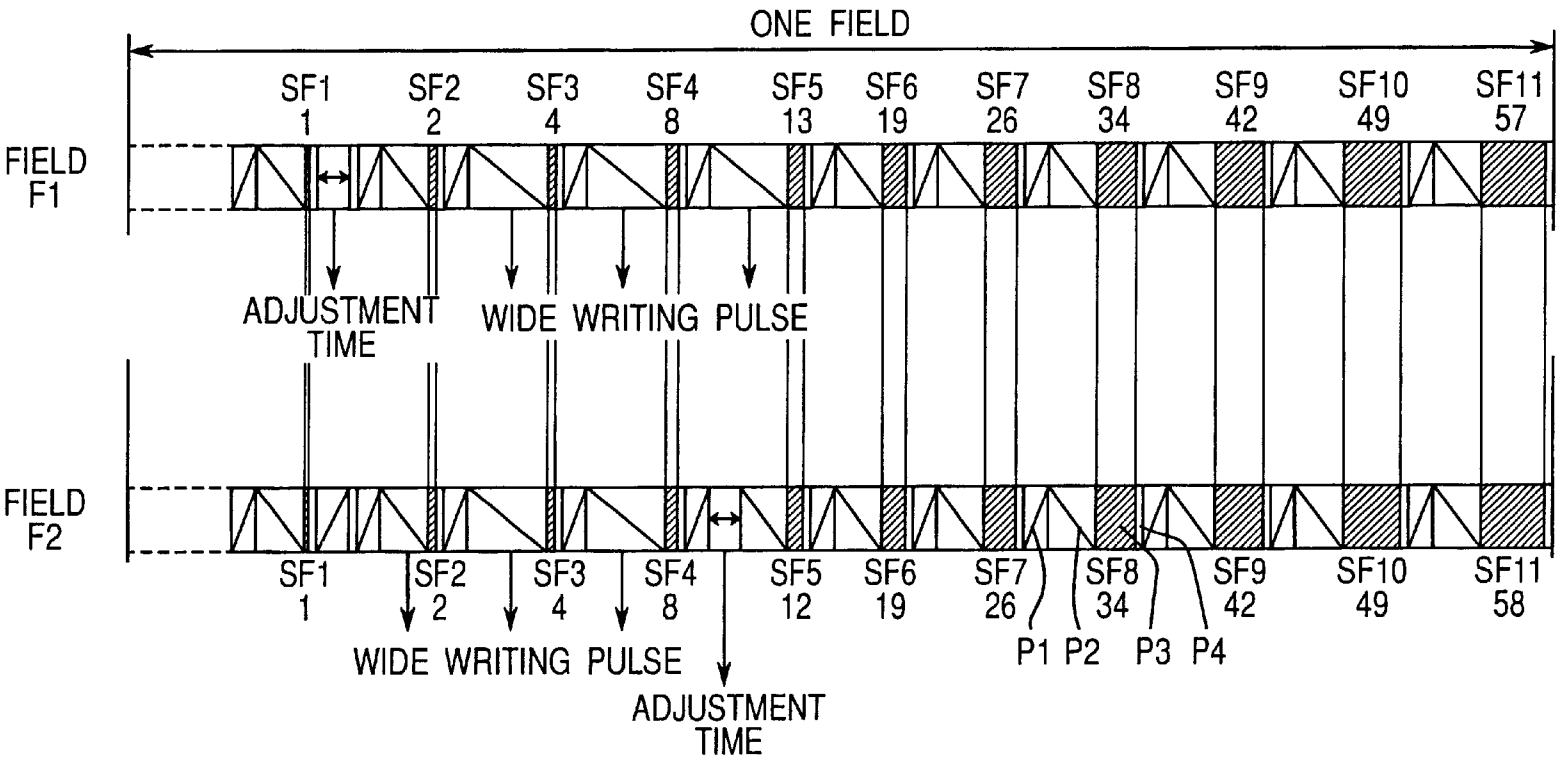
FIG. 13 is a view showing a state in which the shift of the light-emitting positions in the sub-fields of the same number is regulated between two fields in which the sub-fields that use the wide writing pulse differ from each other.

Referring back to FIG. 12, the regulator 16 regulates the start time, i.e., the arrangement position of each sub-field within one field of the drive signal produced by the sub-field processor 10 according to the table selected by the table selector 14. Specifically, the state in which the arrangement of the sub-fields of the fields F1 and F2 are regulated according to the above Tables 5A and 5B is shown in FIG. 13. In the field F1, an adjustment time is inserted between the sub-fields SF1 and SF2, and the start time of the sub-field SF1 is advanced by 300 μsec with respect to the pre-regulation start time shown in Table 4A. On the other hand, in the field F2, an adjustment time is inserted between the sub-fields SF4 and SF5, and the start times of the sub-fields SF1 through SF4 are advanced by 300 μsec with respect to the pre-regulation start time shown in Table 4B. As a result, each sustaining period P3 from the sub-fields SF1 to SF11 in the fields F1 and F2 is arranged approximately in an identical position within one field.

With regard to the video image displayed by inputting the thus-regulated drive signal from the regulator 16 into the PDP 18, the light emission in the sub-fields of the same numbers is periodically executed field by field. Therefore, no unnatural change in brightness occurs, and a stabilized brightness is obtained.

The table stored in the memory table 12 is only required to include at least the start time of each sub-field and is allowed to eliminate the light emission start time of each sub-field.

The above second embodiment has been described taking the field F1 and the field F2 having the same number of sub-fields as an example. However, if the number of sub-fields changes between continuous fields, e.g., if a field having 11 sub-fields succeeds a field having 10 sub-fields, then it is proper to execute regulation so that the sub-fields SF1 through SF10 of the preceding field and the sub-fields SF2 through SF11 of the succeeding field become located approximately in identical positions within one field. The same thing can be said for the reverse case.

As described above, according to the display device of the present invention, the width of the writing pulse is expanded at all the gray scale levels in the sub-fields in which the time lag of discharging for writing tends to occur, and therefore, the discharging for writing is reliably executed in each sub-field. This can prevent the occurrence of non-light-emitting sub-field and pixel, allowing a satisfactory gray scale video image to be displayed.

Moreover, the wide writing pulse is used only for the sub-fields in which the writing error tends to occur. Accordingly, there occurs no reduction in the number of sub-fields that can be provided in one field in contrast to the case where the wide writing pulse is used in all the sub-fields.

Furthermore, according to the display device of the present invention which is provided with a means for regulating the shift in light-emitting position of the sub-fields within one field occurring as a consequence of the use of the wide writing pulse in the specified sub-fields, no unnatural change in brightness occurs in the displayed video image, allowing a stabilized brightness to be obtained.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included thereto.

What is claimed is:

1. A display device that executes gradational light emission at each pixel every field by forming Z sub-fields of first to Z-th from a video signal in which brightness of each of pixels in one field is represented by Z bits in such a manner that a first sub-field in which zeros and ones obtained by collecting only the first bit of Z bits from the whole screen are arranged is constructed and a second sub-field in which zeros and ones obtained by collecting only the second bit of Z bits from the whole screen are arranged is constructed, weighting each of the sub-fields and outputting a number of drive pulses N times the given weight or a drive pulse having a time width N times the given weight, the device comprising:

a writing pulse width setting device that sets a writing pulse width of an attentional light-emitting sub-field to be wider than a normal writing pulse width at all gray scale levels when said attentional light-emitting sub-field is selected, said attentional light-emitting sub-field being selected when at least two non-light-emitting sub-fields continuously exist before said attentional light-emitting sub-field at at least one certain gray scale level among all gray scale levels specified on the basis of the number Z of sub-fields and a weighting of said sub-fields.

2. A display device as claimed in claim 1, wherein the expanded pulse width of the writing pulse is about 20 to 80 percent wider than the pulse width of the normal writing pulse.

3. A display device as claimed in claim 2, wherein the expanded pulse width of the writing pulse is about 60 percent wider than the pulse width of the normal writing pulse.

4. A display device as claimed in claim 1, wherein the width of the writing pulse is expanded for the sub-field of which the weight is more than a specified number.

5. A display device as claimed in claim 4, wherein the specified number is three.

6. A display device as claimed in claim 4, wherein the specified number is five.

7. A display device as claimed in claim 4, wherein the specified number is ten.

8. A display device as claimed in claim 1 further comprising:

a time information source that stores time information of the sub-fields within one field for a variety of fields in which at least one of the number Z of sub-fields, the weighting multiple N and the weighting of the sub-fields is different;

a means for selecting an appropriate sub-field time information from the time information source on the basis of at least one of the specified number Z of sub-fields, the specified weighting multiple N and the specified weighting of the sub-fields; and a means for regulating positions of sub-fields arranged within one field according to the selected sub-field time information, whereby the sustaining periods of the sub-fields are arranged approximately in same positions within one field between fields.

* * * * *